US006441745B1

(12) United States Patent
Gates

(10) Patent No.: US 6,441,745 B1
(45) Date of Patent: Aug. 27, 2002

(54) GOLF CLUB SWING PATH, SPEED AND GRIP PRESSURE MONITOR

(76) Inventor: Cassen L. Gates, 2820 State St., Saginaw, MI (US) 48602

( * ) Notice: Subject to any disclaimer, the term of this patent is extended or adjusted under 35 U.S.C. 154(b) by 0 days.

(21) Appl. No.: 09/531,635

(22) Filed: Mar. 21, 2000

Related U.S. Application Data

(60) Provisional application No. 60/112,551, filed on Mar. 22, 1999.

(51) Int. Cl.[7] ..... G08B 21/00

(52) U.S. Cl. ..... 340/669; 340/670; 340/671; 340/672; 434/252; 473/232; 473/233; 473/131; 473/282; 473/257

(58) Field of Search ..... 340/669, 670, 340/671; 434/252; 473/232, 233, 131, 282, 257

(56) References Cited

U.S. PATENT DOCUMENTS 3,945,646 A * 3/1976 Hammond ..... 273/186
4,991,850 A * 2/1991 Wilhlem ..... 273/186
5,233,544 A * 8/1993 Kobayashi ..... 364/566
5,491,474 A 2/1996 Suni et al.
5,533,386 A * 7/1996 Buttler, Jr. ..... 73/65.01
5,638,300 A 6/1997 Johnson
5,655,223 A 8/1997 Cozza
5,688,183 A * 11/1997 Sabatino et al. ..... 473/212
5,701,307 A 12/1997 Muhs et al.
5,907,819 A * 5/1999 Johnson ..... 702/152

* cited by examiner

*Primary Examiner*—Daniel J. Wu
*Assistant Examiner*—Son Tang
(74) *Attorney, Agent, or Firm*—Reising, Ethington, Barnes, Kisselle, Learman & McCulloch, P.C.

(57) ABSTRACT

The golf club has a head and a shaft. A three axis linear accelerometer is mounted on the shaft adjacent to the head. The axis of one accelerometer is in parallel alignment with an axis of the shaft. A circuit board is attached to the shaft and the accelerometer. The circuit board includes a calibrator for calibrating at least the accelerometer with an axis parallel to the axis of the shaft. The circuit board also has a wireless transmitter. Data from the accelerometer is transferred to a processor by the transmitter. The measured velocity of the club head is displayed by a display device carried by the golfer.

6 Claims, 4 Drawing Sheets

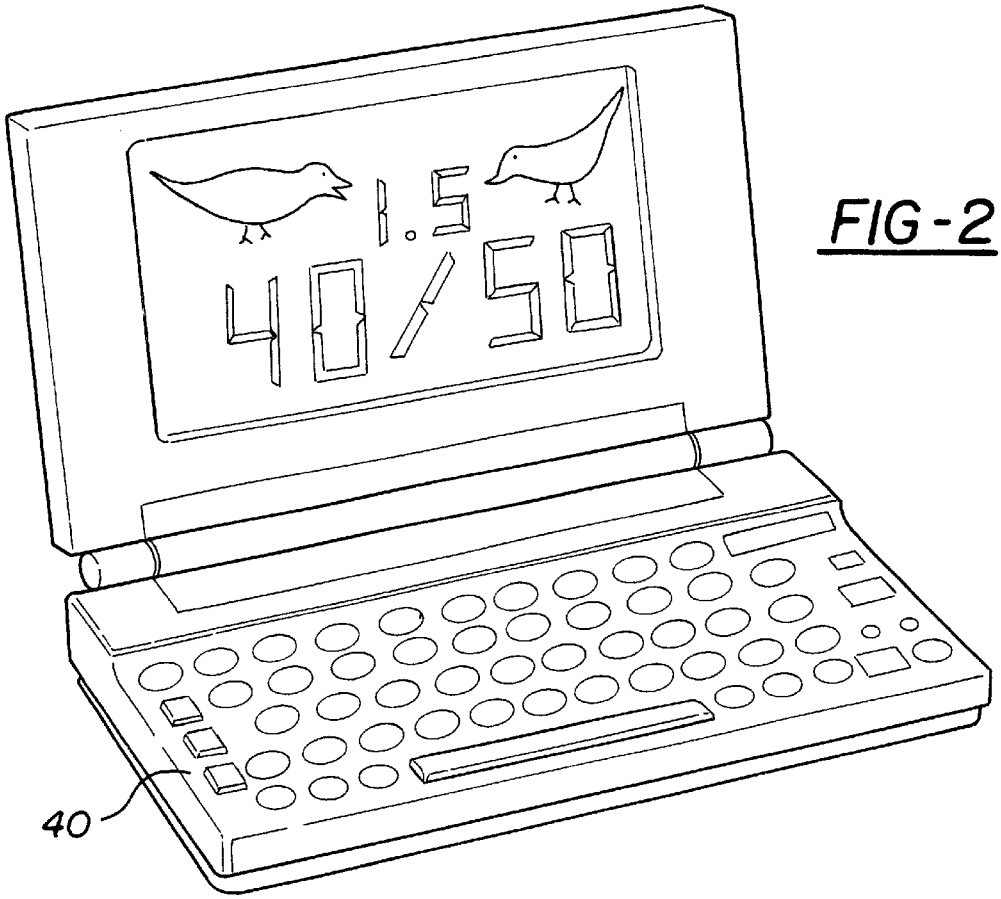
FIG-2
FIG-6
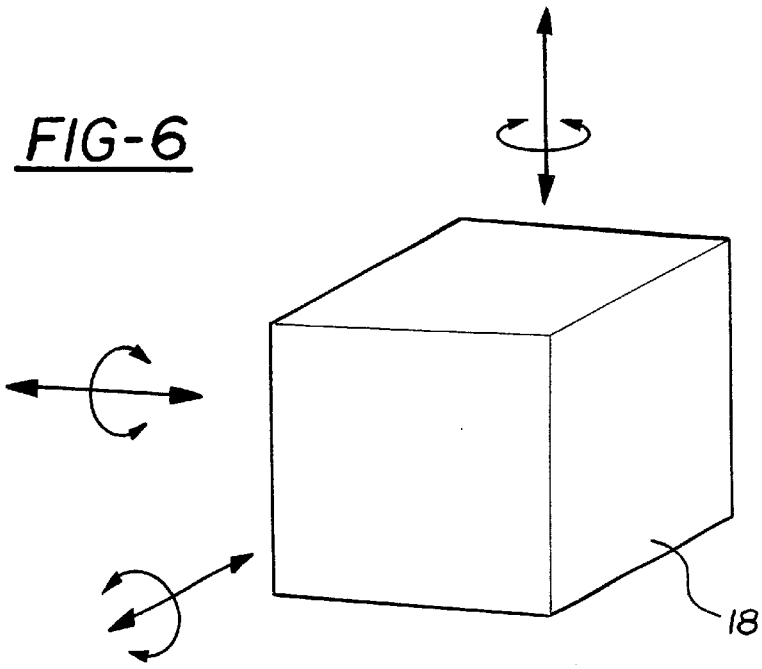

FIG-4
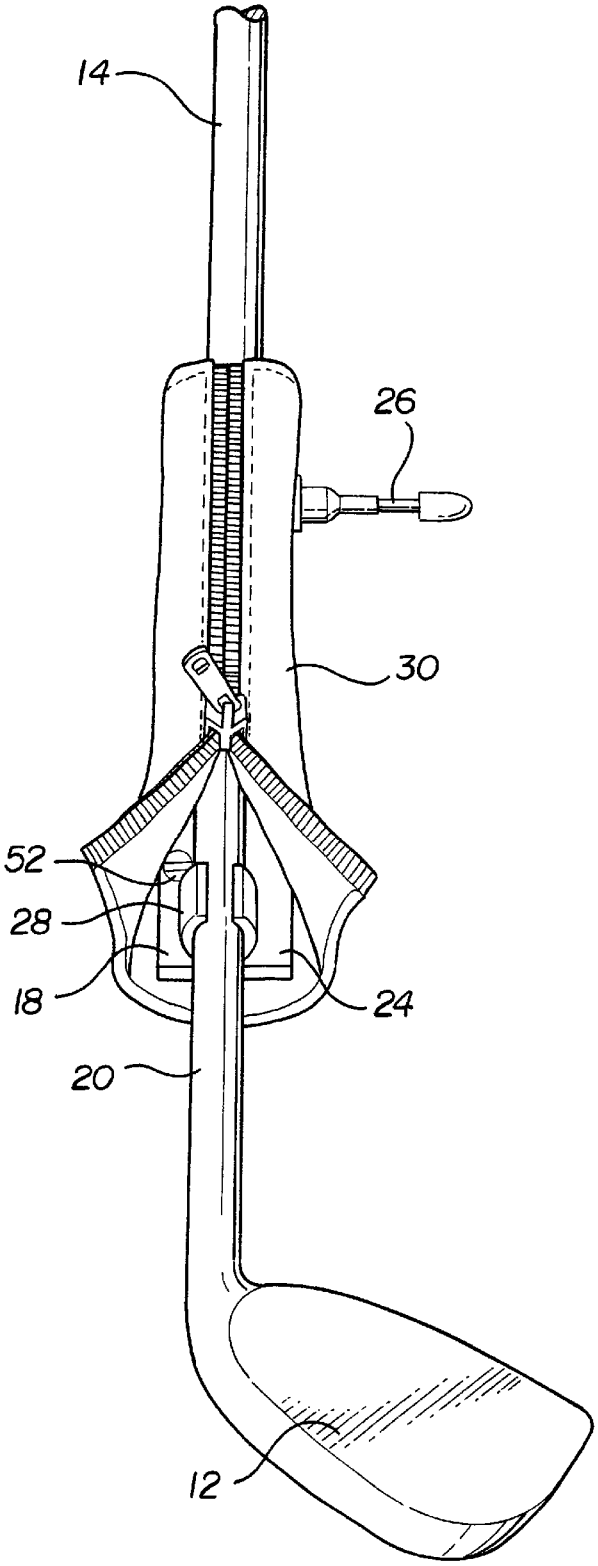
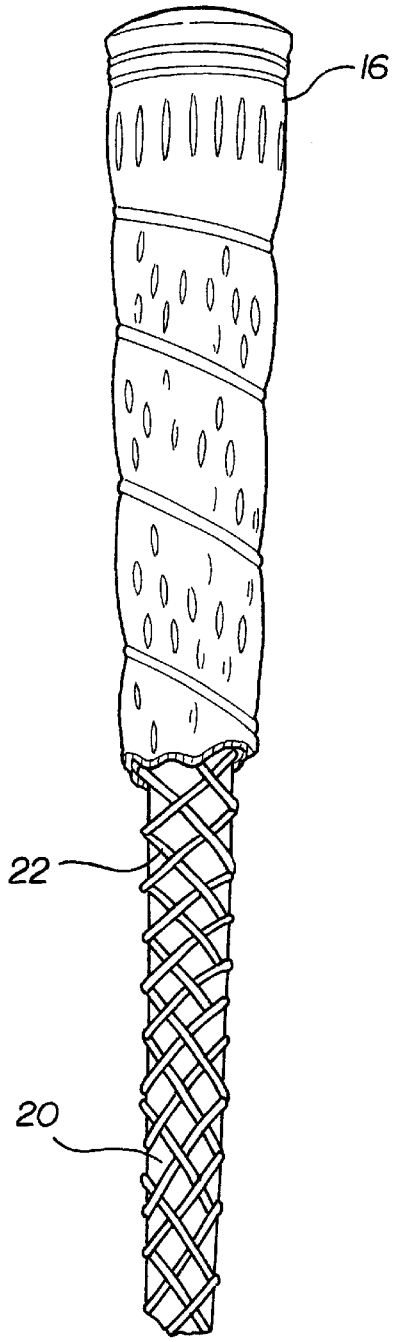
FIG-5

GOLF CLUB SWING PATH, SPEED AND GRIP PRESSURE MONITOR

This application claims the benefit of U.S. Provisional Application(s) No(s).: 60/112,551 filing date Mar. 22, 1999.

FIELD OF THE INVENTION

The invention relates to an apparatus and a method for measuring the speed of movement of the head of a golf club and for plotting the path of movement of a golf club head employing accelerometers. The disclosure incorporates the golf club swing path, speed and grip pressure monitor disclosed in provisional patent application No. 60/112,551, filed Mar. 22, 1999, whose priority is claimed for this application.

BACKGROUND OF THE INVENTION

Golf swing analysis system are available. These systems measure a plurality of movements made by a golfer during a swing of a club. One system places sensors on the golfer's ankles, knees, waist, shoulders, head, elbows and on the club. These sensors are connected to processors by wires. This system is clearly usable only in a lab or a test facility.

Sensors and wires attached to the golfer's body cause a golfer to make some adjustments to his swing. These adjustments in a golfer's swing diminish the value of the test.

Golfers need to have consistent uniform swings. One of the biggest problems encountered is inconsistent golf club swings. A monitor or monitors that will measure some data relating to each swing made by a golfer while playing a round on a golf course can assist a golfer in maintaining consistency.

Monitors that tell a golfer if he changes his grip pressure or the velocity of each swing, from a norm which drives a golf ball a consistent distance, could help some golfers improve their game substantially.

A system which helps a golfer improve his game and monitors each swing should be lightweight and have minimal affect or no affect on a golfer's swing.

Improvements in a golfer's swing could be made by graphing the movements of a club throughout the entire path of movement of the club head. After graphs are made, they are compared to a predetermined norm and analyzed. The golfer can then make appropriate changes to improve specific aspects of his swing.

SUMMARY OF THE INVENTION

The golf club swing monitor includes a linear accelerometer mounted on a golf club shaft adjacent to a head of the golf club. An accelerometer axis of the linear accelerometer is parallel to the club shaft axis. A wireless transmitter mounted on the club transmits a signal from the accelerometer to a display which displays the maximum velocity attained by the head.

A three axis accelerometer can be used if desired. One axis is aligned with the club shaft. Data gathered by the three accelerometers is transmitted to a remote computer for storage and further processing.

BRIEF DESCRIPTION OF THE DRAWINGS

The presently preferred embodiment of the invention is disclosed in the following description and in the accompanying drawings, wherein:

FIG. 2 is a perspective view of a laptop computer used with the monitor;

FIG. 4 is an elevational view of the club end of a golf club with the sensors attached;

FIG. 5 is an elevational view of a grip end of a club with parts broken away; and FIG. 6 is a perspective view of a three axis accelerometer.

DESCRIPTION OF THE PREFERRED EMBODIMENT

Figure 1:
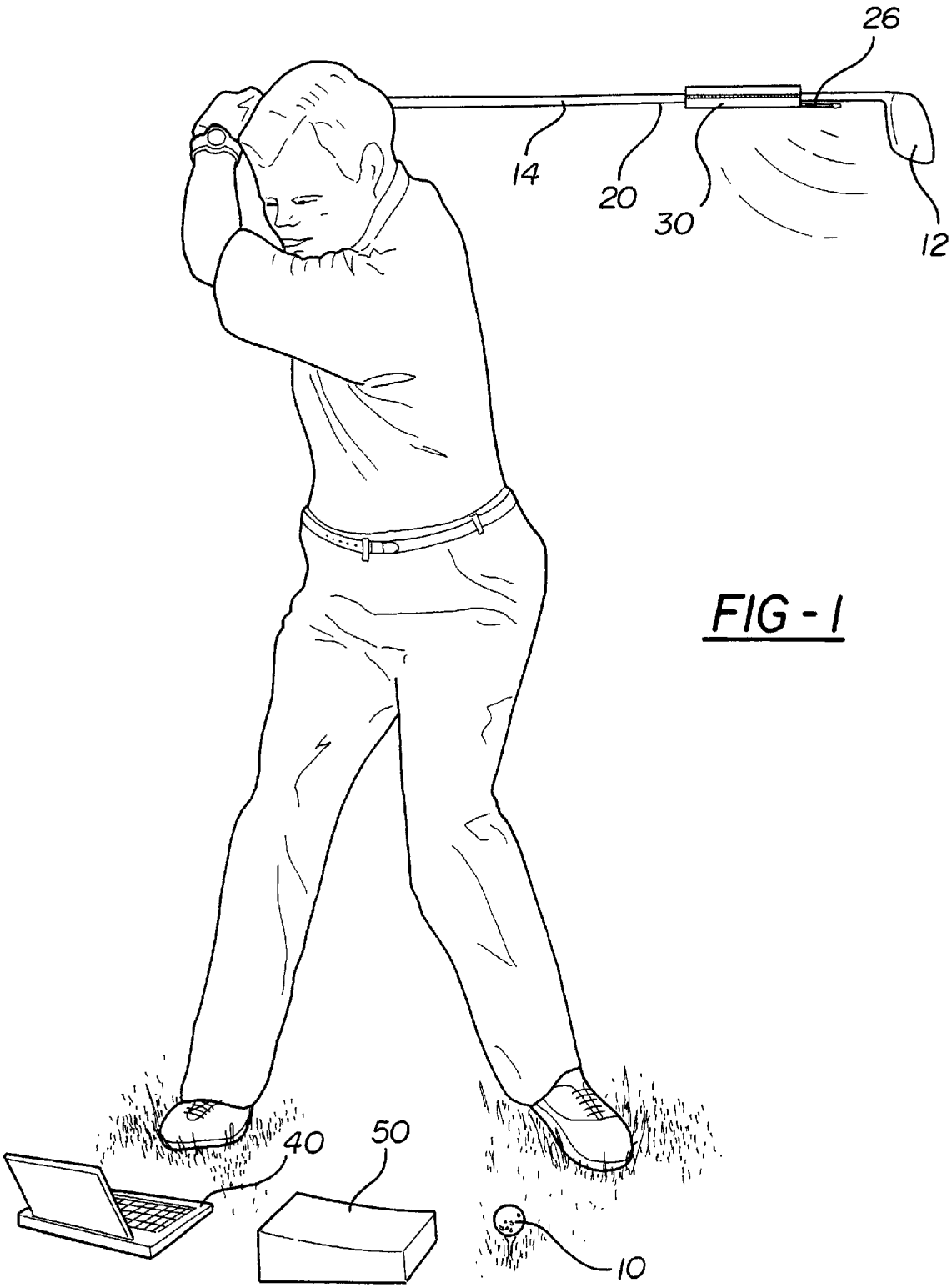
FIG. 1 is an elevational view of a golfer using a golf club employing the monitor.
Figure 3:
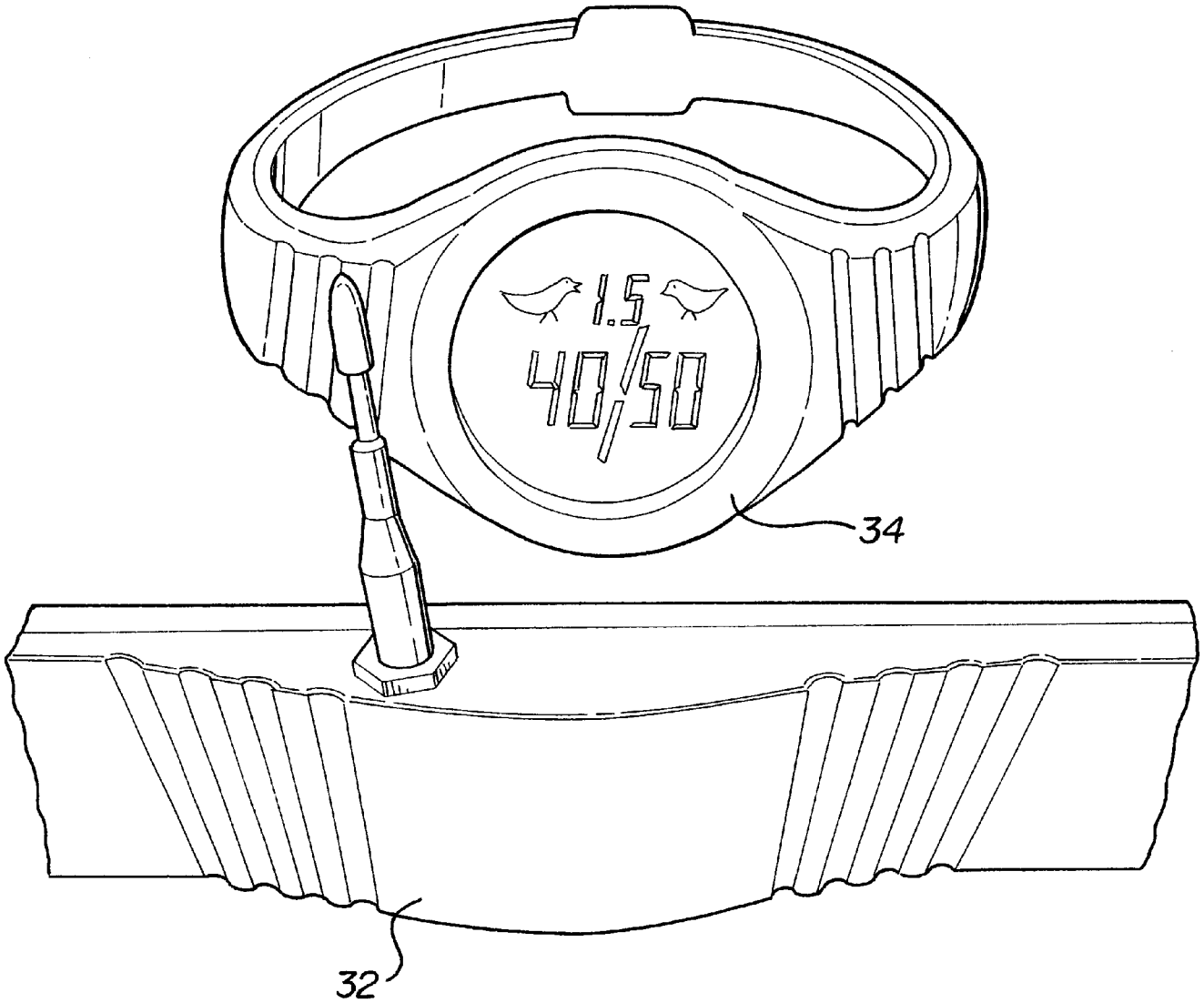
FIG. 3 is a perspective view of a sensor pickup and transmitter employed with the monitor as well as a limited information display carried on the wrist of a golfer.

The flight of a golf ball 10 is dependent upon the attitude, direction of movement, position and speed of the head 12 of a golf club 14 when the ball is struck and the force exerted on the club grip 16 by the golfer's hand at the time the ball is struck. Similar information at any other time or location during the swing of a club 14 is only important insofar as it affects the energy transferred to the ball 10 upon impact by the head 12 of the club 14. In analyzing what the golfer does to transfer energy to the golf club 14, the entire movement of the club including the back stroke, the swing and the follow through are important in that they affect what takes place during impact.

The location as well as the speed of movement of the head 12 of a golf club 14 can be determined by accelerometers 18. In inertial navigation systems that determine the position and speed of an aircraft are based upon accelerometers. In navigation systems, a three axis accelerometer 18 is mounted on a plate that is positioned by a gyroscope. Unfortunately a gyroscope cannot be mounted on a golf club 14.

The position of a golf club 16, relative to a fixed reference location, can be calculated by a plurality of accelerometers 18. These accelerometers 18 are small and lightweight and can be mounted directly upon the shaft 20 of a golf club 16. It would also be possible to mount accelerometers inside the shaft if desired.

Accelerometers 18 may include a three axis linear accelerometer and a three axis rotary accelerometer. The rotary accelerometer will provide data concerning changes in the orientation or attitude of the three axis linear accelerometer. The three axis linear accelerometer will provide data that indicates the direction and speed of movement of the golf club in three planes that are perpendicular to each other. With that information, the velocity of the club head 12 and the direction of movement can be calculated.

A pressure sensor 22 is mounted inside the club grip 16. Pressure exerted on the club grip 16 is important because it affects energy transfer from the club head 18 to a golf ball. The pressure sensor 22 is a strain gauge device.

Accelerometers and strain gauges can employ piezoceramic members, fiber optic members or resistance wire in predetermined patterns. Three axis linear accelerometers are available that have a volume of less than one cubic inch. Angular measurement accelerometers are available in the same size package.

Accelerometer assemblies 18, as shown in the drawing, include a circuit board 24. In addition to the required accelerometers, the circuit board 24 carries a power supply and a wireless transmitter with an antenna 26.

The circuit board 24 is secured to the shaft 20 of a golf club 14 by spring clip members 28. In addition to the spring clip members 28, alignment members are attached to the shank 20 to angularly and axially fix the circuit board relative to the club head 12. The circuit board 24 should be close to the club head 12 to minimize the effects of flexing of the shaft 20. A cover 30 covers the circuit board to provide protection from golf balls and other objects.

The circuit board 24 as describe above can be changed from one golf club 14 to another. If a circuit board is provided for each golf club 14, the circuit board can be rigidly attached to the shaft 20.

The pressure sensor 22 is secured inside the club grip 16. It is therefore desirable to provide a pressure sensor 22 for each golf club 14. A power source and a transmitter are required for the sensor 22. The power source and transmitter can be mounted on the shaft 20 adjacent to the club grip 16 or inside the shaft. In either position the power source can be attached to the pressure sensor.

Signals from the pressure sensor 22 and from the accelerometer 18 are received by a receiver processor 32 worn or carried by the golfer. The processor 32 sends signals to a display 34 worn by the golfer. The display 34 which may be worn on the wrist of a golfer, can provide information concerning grip pressure at any given point during the swing of a golf club such as at impact. Alternatively the display 34 could provide an audible warning if the grip pressure is above a maximum pressure. The display 34 could also provide an audible warning if the pressure measured by the pressure sensor 22 is below a minimum pressure. A golfer can then adjust grip pressure during a swing to bring the actual pressure within a pressure range. The display 34 can also exhibit the speed at which the club head 12 is moving at one point during a swing such as at impact. This information can be used by a golfer to adjust his next swing.

The receiver processor 32 sends complete data from the pressure sensor 22 and from accelerometers 18 to a computer recording device that is several feet away from the ball that is hit. This data can be processed at a later date to provide information concerning the path of movement of the golf club 14 and the club head 12 during the back stroke, the swing and the follow through. The speed at which the club head 12 is moving at any point along its path can be calculated. Grip pressure and pressure changes can be provided at any point along the entire path of movement of the club head 12. The location on the club head 12 of the point of impact with a ball can also be calculated.

The total information provided by the monitor concerning movement of the golf club is very complete. It can easily be compared with the strokes of other golfers as well as multiple strokes by a given golfer. All of this information is obtained with minimal apparatus attached to the golfer and to the golf club. The golfer should not be able to notice any significant difference between hitting the ball with the monitor and without the monitor. The monitor can be used on a golf course during an actual round of golf. The information provided to the golfer while on the course is information that the golfer can use to improve his game during the round that is being played.

The three axis linear accelerator 18 can locate the head 12 of a golf club 14 in a Cartesian coordinate system. The software required to plot the path of movement of the head 12 will be somewhat more extensive than the basic software for an inertial navigation system because the axis of the three linear accelerators will be fixed relative to the shaft 20 of the club 14. There is no gyroscope available to align the axis of the three linear accelerators on a shaft 20 with the earth.

The outputs of the three linear accelerators is recorded by the computer 40 located a few feet from the golfer. This data is processed by the computer 40 or by a larger computer in a facility off the golf course.

Aligning the axis of one of the linear accelerators with the axis of the shaft 20 permits the direct measurement of acceleration due to centrifugal force on the accelerometer 18. The instantaneous velocity of the club head 12 can be calculated from the output of the one linear accelerator 18 that is in axial alignment with the shaft 20.

The acceleration required to move a body in a curved path is calculated by the formula $a=v^2/R$ where "a" is acceleration, "v" is velocity and "R" is the radius of the path. By measuring the acceleration "a" and the radius "R", the velocity "v" can be calculated.

The above formula provides the actual velocity of the accelerometer 18 when the path of movement is in a horizontal plane. When the path of movement is in a plane that is tilted relative to the horizon, as it is in the case of golf club head 12, the force of gravity alters the output of the accelerometer.

The output of the single accelerometer 18 with an axis aligned with the shaft 20 has to be modified by several factors, in addition to gravity, that change the output. The distance of the accelerometer 18 from the club head 12 requires correction. The head 12 is further from the axis of rotation than the accelerometer 18 and will therefore travel at a higher velocity. The length of the shaft 20 changes the radius of the path. Rotation of the shoulders and simultaneously shifting of the wrists changes the radius of the path. The length of the golfer's arms also change the radius of the path of the head 12. The length of the shaft 20 and the length of the arms of an individual golfer remain substantially constant. However, the location of a golfer's hands on the club can vary somewhat and change the radius of the path of the accelerometer 18.

Fortunately, the factors listed above make relatively minor changes in the measured velocity of the club head 12. Gravity for example will change the measure of velocity less than 2%. The changes due to gravity, placement of an accelerometer 18 relative to the head 12, length of the shaft 20 and the length of the golfer's arms are all constant. The location of a golfer's grip on the shaft 20 and changes in his swing are the primary variables.

The maximum speed of the club head 12 is measured by a single axis accelerometer 18 that is axially aligned with the shaft 20. The actual speed of the head 12 is measured with a chronograph 50. The circuit board 24 and the accelerometer 18 are calibrated with a calibrator 52 to provide an output that corresponds to the actual speed measured by the chronograph 50. The signal provided by the calibrated accelerometer 18 will then indicate changes in the speed of the head 12 from one swing to the next. The signal is transmitted from the circuit board 24 to the display 34. The transmission to the display 34 can be direct or it can be through a processor 32. If a three axis accelerometer 18 is employed, the processor 32 is used to reduce the size and weight of the display and to provide the capability of transmitting data to the computer 40.

The maximum speed of a club head 12 is obtained at the bottom of the stroke and at about the location in the swing in which the ball is struck. The acceleration that is display by the display 34 is the maximum acceleration measured by the accelerometer 18.

The maximum acceleration, as described above, is measured by a single axis accelerometer 18. A second accelerometer that has an axis which is perpendicular to the path of movement of a club head 12 and perpendicular to the axis of the shaft 20 is monitored, if desired, to tell the golfer if the club is moving transverse to the golf ball at the time of impact. If the club head 12 is moving straight toward the ball, the second accelerometer will measure zero acceleration.

The disclosed embodiments are representative of presently preferred forms of the invention, but are intended to be illustrative rather than definitive thereof. The invention is defined in the claims.

I claim:

1. An acceleration monitor assembly for measuring acceleration forces on a first golf club head during the swing of a first golf club comprising:

a circuit board having;

at least one power supply battery mounted on said circuit board;

a linear accelerometer for measuring centripetal force, having a first accelerometer axis, mounted on said circuit board, with the first accelerometer axis parallel to a circuit board axis, and connected to the at least one power supply battery;

an accelerometer calibrator, for accommodating changes in the radius of a path of movement of the linear accelerometer, mounted on said circuit board and connected to the linear accelerometer and the at least one power supply battery;

said circuit board releasably mounted on a shaft of the first golf club between a center of the shaft and the first golf club head with the first accelerometer axis and the circuit board axis parallel to a club shaft axis, and releasable from the shaft of the first golf club for transfer to a second golf club;

a wireless transmitter mounted on said circuit board with the linear accelerometer and connected to the linear accelerometer to receive signals generated by the first linear accelerometer and transmit the signals through an antenna connected to the wireless transmitter; and a wireless receiver spaced from said circuit board and the shaft upon which said circuit board is mounted and wherein the wireless receiver receives the signals from the wireless transmitter.

2. An acceleration monitor assembly for measuring acceleration forces on a first golf club head during the swing of the golf club, as set forth in claim 1, including a protective circuit board cover which protects the circuit board, the at least one power supply battery, the linear accelerometer and the wireless transmitter.

3. An acceleration monitor assembly for measuring acceleration forces on a first golf club head during the swing of the first golf club, as set forth in claim 2, wherein the protective circuit board cover also encircles the shaft.

4. An acceleration monitor assembly for measuring acceleration forces on a first golf club head during the swing of the first golf club, as set forth in claim 1, including a second linear accelerometer mounted on said circuit board, having a second accelerometer axis that is perpendicular to the first accelerometer axis, and that is connected to the wireless transmitter and sends signals generated by the second linear accelerometer through the wireless transmitter to the wireless receiver.

5. An acceleration monitor assembly for measuring acceleration forces on a first golf club head during the swing of the first golf club, as set forth in claim 4, including a third linear accelerometer mounted on said circuit board, having a third accelerometer axis that is perpendicular to the first accelerometer axis and that is perpendicular to the second accelerometer axis, and that is connected to the wireless transmitter and sends signals generated by the third linear accelerometer through the wireless transmitter to the wireless receiver.

6. An acceleration monitor assembly for measuring acceleration forces on a first golf club head during the swing of the first golf club, as set forth in claim 5, including a signal storage computer connected to the wireless receiver that receives and stores signals sent by the wireless transmitter.

* * * * *

UNITED STATES PATENT AND TRADEMARK OFFICE

CERTIFICATE OF CORRECTION

PATENT NO. : 6,441,745 B1
DATED : August 27, 2002
INVENTOR(S) : Cassen L. Gates

It is certified that error appears in the above-identified patent and that said Letters Patent is hereby corrected as shown below:

Title page,
Item [60], should read -- Provisional application No. 60/125,551, filed on Mar. 22, 1999. --

Item [56], U.S. PATENT DOCUMENTS, change the name of U.S. PATENT DOCUMENT "5,701,307" to read -- Whetsel --.

Signed and Sealed this

Eleventh Day of February, 2003

JAMES E. ROGAN
*Director of the United States Patent and Trademark Office*